United States Patent [19]

Saller

[11] 4,288,293

[45] Sep. 8, 1981

[54] FORM COKE PRODUCTION WITH RECOVERY OF MEDIUM BTU GAS

[75] Inventor: Erik Saller, Stamford, Conn.

[73] Assignee: FMC Corporation, Philadelphia, Pa.

[21] Appl. No.: 140,392

[22] Filed: Apr. 14, 1980

[51] Int. Cl.[3] ..... C10B 49/10; C10J 3/54

[52] U.S. Cl. ..... 201/6; 48/210; 201/5; 201/30; 201/31; 201/36; 201/38

[58] Field of Search ..... 201/5, 6, 30, 31, 36, 201/38; 48/210

[56] References Cited

U.S. PATENT DOCUMENTS

| | | | |
|---|---|---|---|
| 3,051,628 | 8/1962 | Gorin et al. | 201/31 X |
| 3,140,241 | 7/1964 | Work et al. | 201/31 X |
| 3,254,976 | 7/1966 | Wolf et al. | 48/210 X |
| 3,565,766 | 2/1971 | Eddinger et al. | 201/31 X |
| 3,736,233 | 5/1973 | Sass et al. | 201/31 X |
| 4,056,443 | 11/1977 | Colletta et al. | 201/31 X |

*Primary Examiner*—Frank W. Lutter
*Assistant Examiner*—Roger F. Phillips
*Attorney, Agent, or Firm*—Robert D. Jackson; Frank Ianno

[57] ABSTRACT

In the fluidized carbonization and calcination of coal to form a reactive coal calcinate for admixture with bituminous binder for briquetting, curing, and coking to produce form coke, the improvement of recovering medium BTU gases in the overheads by using as the fluidizing medium oxygen diluted with steam or carbon dioxide and removing the steam or carbon dioxide from the overheads.

7 Claims, 1 Drawing Figure

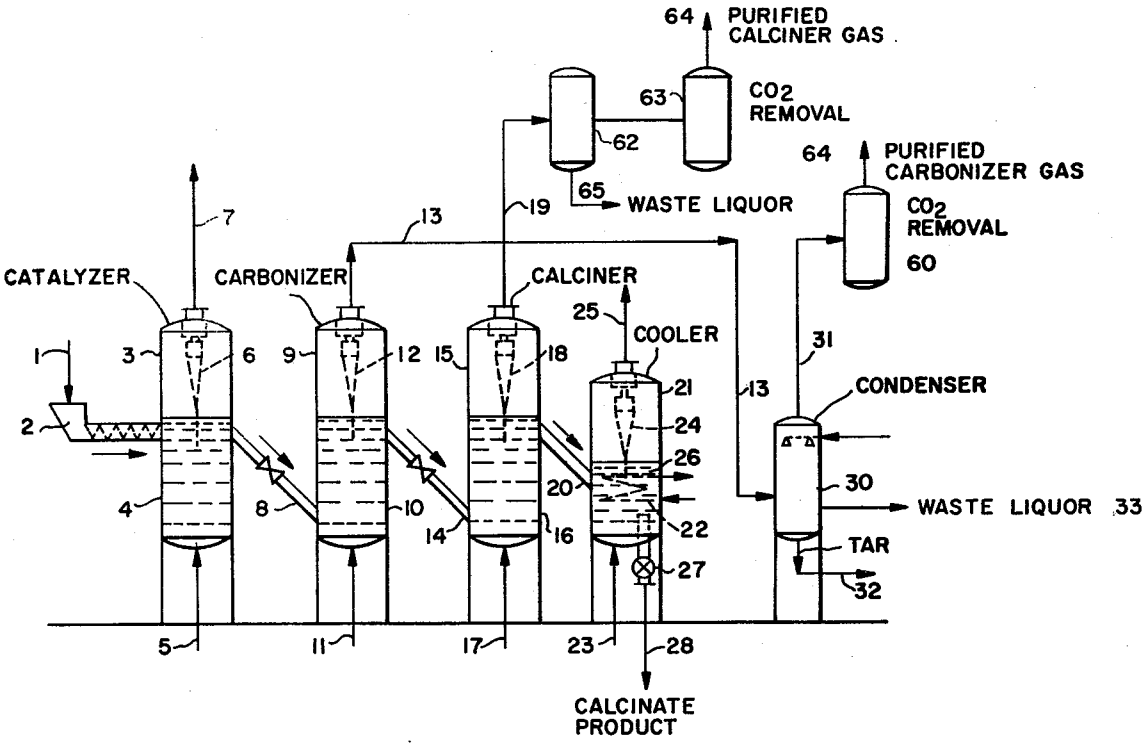
PURIFIED CALCINER GAS
64
CO2 REMOVAL
63
62
WASTE LIQUOR
65
19
13
PURIFIED CARBONIZER GAS
64
CO2 REMOVAL
60
31
CONDENSER
30
WASTE LIQUOR 33
TAR
32
COOLER
21
24
26
22
27
28
CALCINATE PRODUCT
23
CALCINER
25
18
20
16
17
15
14
CARBONIZER
12
10
11
9
8
7
6
5
CATALYZER
3
4
1
2

FORM COKE PRODUCTION WITH RECOVERY OF MEDIUM BTU GAS

This invention relates to the production of medium BTU product gas, particularly in conjunction with the manufacture of form coke.

In U.S. Pat. Nos. 3,140,241 and 3,140,242 to Work, et al, there is described a form coke product which comprises briquettes made by briquetting a reactive coal calcinate with oxidized coal tar pitch, curing the resulting green briquettes in an oxidizing atmosphere and then coking the cured briquettes in an inert atmosphere to reduce the volatile content to less than about 3%. The product is a highly reactive, physically strong carbonaceous material eminently satisfactory for use in metallurgical furnaces including iron smelters. For instance, during commercial blast furnace runs, these briquettes proved generally equal in performance to conventional high temperature coke. In fact, they were superior to oven coke in that their uniform size and shape tend to facilitate furnace operation. Moreover, the briquettes can be manufactured from non-coking coals, an especially attractive feature since it promises to ease the steel industry's dependence on coking coals which are becoming increasingly scarce. In addition, plants for producing the briquettes meets all Federal and State environmental standards whereas coke ovens are highly polluting. Nor is it presently feasible to equip coke ovens with the requisite pollution abating devices.

All things considered, the form coke briquette of the aforecited patents is an ideal carbon reductant for commercial metallurgical purposes.

The reactive coal calcinate used in preparing the form coke briquettes aforesaid is a particulate amorphous carbonaceous material, the surfaces of which are peculiarly susceptible to the formation of strong carbon to carbon bonds with carbon derived from coal tar pitch or other such bituminous binders with consequent formation of strong internal three-dimensional bonds. It is this surface affinity which accounts for the exceptional strength and uniformity of the briquette.

The reactive coal calcinate is obtained by heating coal particles in three distinct stages under conditions which evolve tar-forming vapors. Desirably, the heating is carried out in a fluidized bed. In the first or catalyzing stage, the coal is heated desirably in a fluidized bed in the presence of oxygen to a temperature below which tar-forming vapors are evolved. Heating of the coal particles in the fluidized bed may be effected by burning a small portion of the coal, by sensible heat in the fluidizing medium or by indirect heat exchange. The catalyzed coal is then heated in a second or carbonization stage to evolve tar-forming vapors and produce char particles. The fluidizing atmosphere contains just sufficient oxygen to provide the desired temperature, usually no higher than about 1200° F., by partial combustion of the coal. The oxygen is admitted to the bed in the form of air as a component of the fluidizing medium, the remainder of which may be any gas which is not reactive with the coal particles in this stage. The carbonized coal or char is then heated in a third or calcining stage to give the final reactive coal calcinate. Desirably, calcination is effected in a fluidized bed operated at a sufficient temperature, i.e., about 1400° F. to about 1600° F. to reduce the volatile combustible matter in the end product to below about 3%; heat is provided by limited combustion of the char. According to the Work et al patents, the fluidizing atmosphere is an essentially inert gaseous medium except for the presence of oxygen only in such amount as is demanded by that oxidation rate of the char necessary to supply the heat demands of this stage. Preferably, the fluidizing atmosphere is air or a mixture of air and flue gas.

The binder for the form coke briquettes is preferably obtained by processing the tars recovered from the coal carbonization aforesaid. Such processing consists in air blowing the tar to reduce its water content to about 0.5% and increase its softening point to about 55° C. to 65° C. (ASTM Ring and Ball).

Although the form coke aforesaid has proved to be an effective reductant in metallurgical processes, the by-product the combined carbonizer calciner gases formed during its manufacture have a rather low heating value—about 130 to 170 BTU/SCF compared with about 550 BTU for medium BTU coke oven gas.

Such low heating values were due to the large percentage of inert gases, mostly nitrogen, from air and inert gas specifically recommended as fluidizing atmosphere in the prior art process. Being inert, the nitrogen passed through the fluidizing vessels and appeared as a component of the by-product gases, the heating value of which was greatly reduced by the pressure of the nitrogen.

Up to the time of the energy crisis, the low BTU by-product gas would not have been a significant factor in determining whether to replace a substantial percentage of conventional coke capacity with the herein form coke. Natural gas and oil could be purchased at low cost in virtually unlimited amounts to meet a steel mill's fuel needs. However, at today's cost and availability of energy, there is a need to provide a by-product gas of increased heating value in conjunction with the manufacture of form coke.

In the production of metallurgical form coke briquettes wherein (a) coal particles are heated in the presence of oxygen below tar forming temperatures; wherein (b) the oxidized coal particles from (a) heated to carbonization temperatures to evolve tar forming vapors and give reactive char particles; wherein (c) the reactive char particles from (b) are heated to still higher temperatures to reduce the volatile content of the char to less than about 5% and produce a reactive coal calcinate; wherein (d) the reactive coal calcinate is mixed with bituminous binder and wherein (e) the mixture from (d) is briquetted, cured and coked; it has now been discovered that medium BTU by product gas can be obtained while maintaining coke quality comprising the steps:

A. carrying out carbonization and calcining steps (b) and (c) in a fluidized bed in which the fluidizing atmosphere consists of pure oxygen diluted with steam and/or carbon dioxide while the temperature of step (c) is maintained below that at which substantial gasification occurs;

B. collecting gaseous overheads from steps (b) and (c);

C. separating the fluidizing atmosphere from the overheads; and

D. recovering medium BTU gas therefrom by condensation of the steam and/or removal of the $CO_2$ by absorption.

In the accompanying drawing there is shown a flow sheet illustrating a preferred arrangement of equipment for practicing the invention.

In carrying out the invention herein, the process of the Work, et al patent is followed generally except that the carbonizing and calcining vessels are fluidized with steam and/or carbon dioxide which are then separated from the vessel overheads and the resulting fuel gases recovered. Heat for the carbonization and calcination is provided by partial combustion of carbonaceous materials in the reaction vessels with oxygen incorporated in the fluidizing medium. The oxygen should be added only in an amount as required for the combustion to supply the heat demand of these stages. In general, the concentration of oxygen in the fluidizing atmosphere is about 18 to 30%, preferably about 20 to 25%. Surprisingly, it was found that by operating in accordance with the invention a detailed description of which follows, calcination can be effected in a fluidizing atmosphere of steam or carbon dioxide while preventing gasification of the calcinate from approaching levels at which the coke quality and yield is impaired.

Where the fluidizing medium in the carbonizing zone is a mixture of oxygen and steam, cooling of the evolved gaseous components results in the tar vapors being condensed to tar and the steam condensed to water. This leaves a crude carbonizer gas comprising an essentially nitrogen free mixture of fuel gases and carbon dioxide plus a small amount of nitrogen, usually about 1 to 2%. The heating value of the crude carbonizer gas is about 500 to 600 BTU/SCF.

Freeing the crude carbonizer gas of carbon dioxide is effected in the known manner such as by absorption in an alkaline or amine solution followed by stripping using known techniques. Since carbon dioxide is always formed during carbonization, it is evident that it might be advantageous to treat the crude carbonizer gas as above described even if carbon dioxide is not added to the fluidizing atmosphere. The purified carbonizer gas which can be used by itself or combined with calciner gas to give a mixed by product gas having a heating value of about 500 to 600 BTU/SCF on a $N_2$ free basis and 900 to 1000 BTU/SCF on a $N_2$—$CO_2$ free basis.

The char particles from the carbonization stage are heated to reduce the amount of volatile combustible matter remaining therein to below about 3 to 5%. This calcination is achieved in a fluidized bed in which the fluidizing atmosphere is steam or carbon dioxide mixed with just enough oxygen as is required by that oxidation rate of the char necessary to supply the heat demands of this stage. In general, the concentration of oxygen in the fluidizing atmosphere is 18 to 25%, preferably about 20–21%. In the case of high rank coals, calcination can be carried out at a temperature range of 1400° F. to 1500° F. and for a residence time of from about 3 minutes to about 30 minutes while keeping carbon losses to a minimum due to gasification, typically not in excess of about 4%. The calciner off gases are sent to a cooling zone where steam is condensed out and a refined calciner gas containing carbon dioxide and fuel gases recovered, having a heating value of about 330 to 400 BTU/SCF on a $N_2$ free basis and about 400 to 450 on a $N_2$ and $CO_2$ free basis. Carbon dioxide added to the fluidizing atmosphere is removed by absorption in amine or alkaline solution as previously described. Even when carbon dioxide is not used in fluidizing gas it might be advantageous to remove the carbon dioxide formed in the calciner.

At a calciner temperature of 1400° F. to 1500° F. low rank coals, such as Elkol coal, will show a considerable amount of gasification and activation of the calcinate resulting in lower coke yield and inferior coke quality. For such coals, calcination is carried out in two stages the first operated at 1250° to 1350° C. with oxygen and steam or $CO_2$ for fluidization and the second at 1400° to 1600° F. using air for fluidization with only the gas from the first stage being combined with the carbonizer gas. In the second stage the semi-calcined char particles from the first stage calcination are further heated to reduce the volatile combustible matter to below about 3 to 5% in accordance with the teachings of the Work, et al patents. Desirably, this calcination is achieved in a fluid bed operating at the minimum temperature necessary to achieve this reduction, for example, from about 1400° F. to 1500° F., and for a residence time of from about 3 minutes to about 20 minutes. The primary effect of this calcining is to increase the physical strength of the calcinate and final coke in the known manner of the Work, et al patents. Gases from the second calciner step can be used for process heat.

Under certain conditions of operating the process herein, it may be desirable to use carbon dioxide ($CO_2$) instead of steam as a diluent for the oxygen. For instance, in the range of 1500° F. to 1600° F., the steam reactivity of calcinate made from Elko coal is more than double its $CO_2$ reactivity, clearly indicating a further advantage of $CO_2$ over steam as a diluent, particularly for low rank coals. An added potential advantage of $CO_2$ over steam is that the amount of waste liquor to be treated prior to disposal is decreased.

The use of $CO_2$ when producing medium BTU gas will increase the number of coals that can be processed in the 3 fluidizing stages of the Work, et al form coke process, but some coals, particularly in the range of lignites, will still require two stage calcining as above discussed in order to avoid excessive gasification and to maintain an acceptable coke quality. Since some $CO_2$ is generated in the form coke process of the cited patents from oxygen in the coal itself and through combustion, there will be a net discharge of $CO_2$.

The calcined char is cooled, mixed with bituminous binder, formed into briquettes which are cured and coked in the normal manner.

Referring to the drawing which shows a preferred arrangement of equipment for practicing the process of this invention, pulverized coal feed (1) is fed into screw conveyor (2) which discharges continuously into catalyzer (3) wherein the coal particles are heated under oxidizing conditions in fluidized bed (4) supplied with fluidizing gas stream (5). Heat is added through an internal steam tube bundle or by means of a fluidizing gas preheater fired with gas, oil or coal fines. The catalyzer is equipped with an internal cyclone separator (6) through which gases evolved in the catalyzer are discharged through line (7).

The catalyzer (3) discharges coal continuously through line (8) into the carbonizer (9). The carbonizer contains a fluidized bed (10) of the catalyzed coal particles. A stream of oxygen containing steam or carbon dioxide (11) is supplied as the fluidizing medium. The carbonizer (9) is equipped with an internal cyclone separator (12) through which gases evolved in the carbonizer are discharged. A gas take-off line (13) leads from the cyclone separator (12) to the condenser (30) wherein tar and steam is condensed hereinafter described. The carbonizer gas from the condenser (30) is led to a $CO_2$ removal zone (60) where $CO_2$ is absorbed in an alkaline solution and the purified carbonizer gas

(64) recovered having a heating value of 500 to 600 BTU/SCF or 900 to 1000 on a $CO_2$—$N_2$ free basis.

Carbonizer (9) discharges char continuously through line (14) into the calciner (15) which contains a fluidized bed (16) of calcinate particles. The fuidizing medium (17) is a stream of oxygen containing steam or carbon dioxide. Calciner (15) is equipped with an internal cyclone separator (18) through which fuel gas is discharged through line (19). Calciner (15) discharges calcined char continuously through line (20) into the cooler (21) comprising a fluidized bed (22) of calcined char particles fluidized by a stream of inert gas supplied through line (23). The cooler is equipped with an internal cyclone separator (24) through which gases are discharged through line (25). Cooler (21) is provided with internal cooling coils (26) through which a suitable cooling medium may be circulated. Calcinate is continuously discharged to intermediate storage from the cooler (21) through a rotary valve (27). Tar (32) is recovered from condenser (30) and processed into binder pitch which is then mixed with the calcinate product (28) and the mixture briquetted, cured and coked as detailed in the Work, et al patents. The gases from (19) are treated in recovery zone (62) to condense steam and is then passed to carbon dioxide removal zone (63) to give a purified calciner gas (64) having a heating value of about 400 to 450 BTU/SCF. If carbon dioxide is not removed the calciner gas will have a heating value of 330 to 400 BTU/SCF. The purified carbonizer and calciner gases can be mixed to give a medium BTU gas mixture equal in heating value to coke oven gas.

The following examples are illustrative of the process of the invention. It will be appreciated that the invention is not limited thereto.

Coal was ground in a hammermill equipped with an $\frac{1}{8}$ inch mesh screen to provide finely divided coal particles. These were then subjected to the three stage, sequential heat treatment in fluidized beds as previously described. The first stage or catalyzer vessel was 10 inches in diameter while that of the carbonizer and calciner vessels each measured 8 inches. The coal feed rate was 60 to 80 pounds/hour while the fluidizing gas was introduced at a rate of 0.8 to 1.0 feet/second. In all of the examples, the first stage or catalyzing treatment of the coal in which it was heated below tar forming temperatures, was identical and did not yield a combustible gas. Accordingly, only the data from the carbonizing and calcining are given. The coal used was Illinois No. 6 coal, a bituminous B, weakly coking coal.

Reference is now made to the tables in which Table I shows examples of the prior art (U.S. Pat. Nos. 3,140,241 and 3,140,242) using air as the fluidizing atmosphere for carbonization and calcination of coal particles; Table II shows examples of the invention in which air of the prior art is replaced with steam and oxygen as the fluidizing atmosphere; Table III shows form coke quality using calcinate produced by the process of the invention.

In carrying out the carbonization and calcination, nitrogen is conveniently used as a transport gas for conveying the carbonaceous solids from one vessel to the other. As a consequence, the fuel gases produced in the small scale pilot vessels aforesaid are contaminated with transport nitrogen as well as nitrogen from instrument purging. Because the feed is introduced above the bed the transport nitrogen does not affect the reacting atmosphere in the bed, but acts only as a diluent. In the commercial operation of the invention where steam would be used both as a transport and as a fluidizing medium, the quantity of nitrogen from instrument purging would be insignificant relative to the volume of fuel gases. The commercial prior art process, does, of course, produce fuel gases containing nitrogen from the air used as the fluidizing gas.

Since the process of the invention, as practiced commercially, would be operated under essentially nitrogen free conditions, the data generated from the pilot scale examples in Tables I and II are reported on a nitrogen and nitrogen-carbon dioxide free basis. This also enables valid comparison to be made between the process of the invention and that of the prior art using air as the fluidizing atmosphere as shown in Table I. It is to be emphasized that under actual operating conditions the prior art does not provide $N_2$—$CO_2$ free gases whereas the process of the invention does. As can be seen from an inspection of Tables I and II, similar heating values are obtained for carbonizer and calciner gases, on a nitrogen and carbon dioxide free basis, thus indicating that the use of carbon dioxide and/or steam as a fluidizing medium does not adversely affect the quality of recovered fuel gases.

Moreover, the quality and yield of form coke produced by the process of the invention is not adversely affected. For instance, in example 1 of Table II, a 66.2% yield of coke, based on the dry coal, was realized when calcining at a temperature of 1400° F. This is virtually identical to coke yields obtained when following the procedure of the prior art Work et al patents. Even in example 2, when calcining at 1500° F., the coke yield was 62.8%—less than 4% under the prior art average. However, this is at least partly offset by the increase in BTU's of the combined gases; Thus, calcining at 1500° F. gives a yield of 6.3 MM BTU/ton calcinate using the oxygen and steam of the invention as the fluidizing atmosphere compared to 3.4 MM BTU/ton using air of the prior art. At a calcining temperature of 1400° F., total gas heat content is: $4.9\times10^6$ BTU for both modes of operation.

Based on large scale blast furnace tests, an acceptable quality form coke would have a crush strength of about 1400 lbs. and a modified tumbler index of 25.5% minus $\frac{1}{4}$ inch. Table III lists the crush strength and modified tumbler index of coke produced by the herein invention. It will be observed that for both calcining temperatures, the coke quality exceeds the aforesaid standards. However, the coke produced at 1500° F. has about 200 lbs. higher crushing strength than the coke produced at a calcining temperature of 1400° F. As previously noted, a higher crushing strength is associated with slightly lower coke yield.

The tumbler index is determined by a modified ASTM procedure D-441. In this procedure the tumbler is operated for 700 revolutions and the % minus $\frac{1}{4}$ inch screen fraction of the tumbled coke is reported as the tumbler index.

The crushing strength is reported in pounds and is determined as the pressure at which the coke briquette breaks under hydraulic pressure applied between two parallel flat surfaces.

TABLE I

AIR OPERATION*
Gas Analysis on a $N_2$ Free Basis

| Vol % | Carbonizer Gas 900° | Calciner Gas 1400° | Calciner Gas 1500° | Combined Gas 900–1400° | Combined Gas 900–1500° |
|---|---|---|---|---|---|
| $CO_2$ | 35.2 | 13.5 | 14.2 | 18.6 | 18.6 |
| CO | 23.7 | 24.7 | 21.3 | 24.5 | 21.8 |
| $H_2$ | 5.2 | 47.4 | 52.2 | 37.6 | 42.4 |
| $CH_4$ | 25.4 | 14.3 | 12.3 | 16.9 | 15.1 |
| $C_2$ | 5.6 | 0.1 | — | 1.9 | 1.1 |
| $C_3$ | 4.3 | — | — | 1.0 | 0.9 |
| Others | 0.6 | — | — | 0.1 | 0.1 |
| Gross Heat BTU/SCF | 589 | 384 | 367 | 431 | 413 |
| $N_2$—$CO_2$ Free | 908 | 443 | 427 | 529 | 507 |
| Estm $N_2$ Content Commercial Basis | 76 | 55 | 55 | 61 | 61 |
| Estm Actual Heating Value BTU/SCF | 141 | 173 | 166 | 167 | 158 |
| $10^6$BTU/Ton Calcinate | | | | 4.9 | 5.4 |
| Calcinate Yield, % of Dry Coal | | | | 66.6 | 65.5 |

Degrees in Farenheit
*U.S. Pat. Nos. 3,140,241 and 3,140,242 to Work, et al

TABLE II

Oxygen-Steam Operation

| Vol % | Carbonizer Gas 920° F. $N_2$ Free | Carbonizer Gas 920° F. $N_2$—$CO_2$ Free | Calciner Gas 1400° F. $N_2$ Free | Calciner Gas 1400° F. $N_2$—$CO_2$ Free |
|---|---|---|---|---|
| $CO_2$ | 38.5 | — | 15.9 | — |
| CO | 22.2 | 36.1 | 23.3 | 27.7 |
| $H_2$ | 4.4 | 7.2 | 47.8 | 56.8 |
| $CH_4$ | 24.7 | 40.1 | 12.9 | 15.4 |
| $C_2$ | 5.4 | 8.7 | — | — |
| $C_3$ | 4.1 | 6.7 | 0.1 | 0.1 |
| Others | 0.7 | 1.2 | — | — |
| | 100.0 | 100.0 | 100.0 | 100.0 |
| Gross Heating Value BTU/SCF | 571 | 928 | 370 | 440 |
| Estimated Inert Content, Commercial Basis | 1–2% | | | |

| Vol % | Calciner Gas 1500° F. $N_2$ Free | Calciner Gas 1500° F. $N_2$—$CO_2$ Free |
|---|---|---|
| $CO_2$ | 17.0 | — |
| CO | 24.6 | 29.6 |
| $H_2$ | 48.0 | 57.9 |
| $CH_4$ | 10.3 | 12.4 |
| $C_2$ | — | — |
| $C_3$ | 0.1 | 0.1 |
| Others | — | — |
| | 100.0 | 100.0 |
| Gross Heating Value BTU/SCF | 341 | 412 |
| Estimated Inert Content, Commercial Basis | 1–2% | |

| Vol % | Combined Gas 920–1400° $N_2$Free | Combined Gas 920–1400° $N_2$—$CO_2$ Free | Combined Gas 920–1500° $N_2$ Free | Combined Gas 920–1500° $N_2$—$CO_2$ Free |
|---|---|---|---|---|
| $CO_2$ | 20.1 | — | 19.8 | — |
| CO | 23.3 | 29.2 | 24.5 | 30.5 |

TABLE II-continued

| | Oxygen-Steam Operation | | | |
|---|---|---|---|---|
| $H_2$ | 38.1 | 47.7 | 41.0 | 51.1 |
| $CH_4$ | 16.0 | 20.0 | 12.8 | 16.0 |
| $C_2$ | 1.4 | 1.7 | 0.9 | 1.2 |
| $C_3$ | 0.9 | 1.2 | 0.8 | 1.0 |
| Others | 0.2 | 0.2 | 0.2 | 0.2 |
| | 100.0 | 100.0 | 100.0 | 100.0 |
| Gross Heating Value BTU/SCF | 423 | 530 | 384 | 479 |
| Estimated Inert Content, Commercial Basis | | 1–2% | | |
| MM BTU/Ton Calcinate | | | 4.9 | 6.3 |
| Calcinate Yield % | | | 66.2 | 62.8 |
| | Air Case MM BTU/Ton Calcinate | | 4.9 | 5.4 |
| | % Calcinate Yield | | 66.6 | 65.5 |

TABLE III

Coke Quality vs. Operating Conditions

| Standard* | | Oxygen-Steam Operation | 925–1400° | 925–1500° |
|---|---|---|---|---|
| Crushing Strength lbs. | 1400 | Crushing Strength lbs. | 1510 | 1799 |
| Modified Tumbler %-¼" at 700 rev. | 25.5 | Modified Tumbler %-¼" at 700 rev. | 23.2 | 24.9 |

*Average quality of coke used successfully in 20,000 tons blast furnace test - air operation

I claim:

1. In the production of metallurgical form coke briquettes wherein:

(a) coal particles are heated in the presence of oxygen below tar forming temperatures; wherein (b) the oxidized coal particles from (a) are heated to carbonization temperatures to evolve tar forming vapors and give reactive char particles; wherein (c) the reactive char particles from (b) are heated to still higher temperature to reduce the volatile content of the char to less than about 5% and produce a reactive coal calcinate; wherein (d) the reactive coal calcinate is mixed with bituminous binder and wherein (e) the mixture from (d) is briquetted, cured and coked; the improvement of producing medium BTU by product gas while maintaining coke quality comprising the steps:

A. carrying out carbonization and calcining steps (b) and (c) in a fluidized bed in which the fluidizing gas introduced consists of pure oxygen diluted with steam or carbon dioxide while the temperature of step (c) is maintained below that at which substantial gasification occurs;

B. collecting gaseous overheads from steps (b) and (c);

C. separating the diluent from the overheads; and

D. recovering medium BTU gas therefrom.

2. The process according to claim 1 wherein the fluidizing gas is oxygen diluted to 18 to 30% by volume with steam, said steam being separated from the overheads by condensation.

3. The process according to claim 2 wherein carbon dioxide formed during carbonization and calcination is separated from the overheads.

4. The process according to claim 1 wherein the fluidizing gas is oxygen diluted to 18 to 30% by volume with carbon dioxide, said carbon dioxide being separated from the fluidizing atmosphere by adsorption in an alkaline solution.

5. The process according to claim 1 wherein step (c) is carried out at a temperature of about 1400° F.

6. The process according to claim 1 wherein step (c) is carried out at a temperature of about 1500° F.

7. The process according to claim 1 wherein easily gasified coals are calcined in two steps, the first step being operated with oxygen diluted with steam or carbon dioxide as the fluidizing gas at about 1250° F. to 1350° F. and the second stage being operated with air and inert gas as the fluidizing gas at about 1400° F. to 1500° F.

* * * * *

UNITED STATES PATENT AND TRADEMARK OFFICE

CERTIFICATE OF CORRECTION

PATENT NO. : 4,288,293

DATED : 9/8/81

INVENTOR(S) : Erik Saller

It is certified that error appears in the above—identified patent and that said Letters Patent is hereby corrected as shown below:

Column 4, line 3, "1350°C." should read --1350°F.--. Column 4, line 24, "ELKO" should read --ELKOL--. Column 5, line 5, "fuidizing" should read --fluidizing--. Column 6, line 38, "gases; Thus," should read --gases. Thus,--.

Signed and Sealed this

*Thirtieth* Day of *March 1982*

[SEAL]

*Attest:*

GERALD J. MOSSINGHOFF

*Attesting Officer*

*Commissioner of Patents and Trademarks*